US005924316A

United States Patent [19]

Streubel et al.

[11] Patent Number: 5,924,316

[45] Date of Patent: Jul. 20, 1999

[54] METHOD OF MANUFACTURING PIPES HAVING SECTIONS WITH DIFFERENT WALL THICKNESSES

[75] Inventors: Wolfgang Streubel, Detmold; Udo Klasfauseweh, Gütersloh, both of Germany

[73] Assignee: Benteler AG, Paderborn, Germany

[21] Appl. No.: 08/795,568

[22] Filed: Feb. 6, 1997

[30] Foreign Application Priority Data

Feb. 7, 1996 [DE] Germany ..... 196 04 357

[51] Int. Cl.[6] ..... B21D 34/02; B21D 51/28

[52] U.S. Cl. ..... 72/51; 72/367.1; 72/368

[58] Field of Search ..... 72/51, 52, 367.1, 72/368, 370.14, 370.15, 370.23, 370.24, 177

[56] References Cited

FOREIGN PATENT DOCUMENTS 3343709 6/1984 Germany .

*Primary Examiner*—Joseph J. Hail, III
*Assistant Examiner*—Rodney Butler
*Attorney, Agent, or Firm*—Friedrich Kueffner

[57] ABSTRACT

A method of manufacturing pipes having sections with different wall thicknesses from an initially plane sheet metal in which a starting sheet metal is subjected to a rolling deformation so as to intentionally produce areas of different wall thicknesses in rolling direction. Subsequently, the rolled sheet metal is cut to size as required. The intermediate product obtained in this manner is then shaped into a pipe and the abutting edges are then joined together.

2 Claims, 2 Drawing Sheets

METHOD OF MANUFACTURING PIPES HAVING SECTIONS WITH DIFFERENT WALL THICKNESSES

BACKGROUND OF THE INVENTION

1. Field of the Invention

The present invention relates to a method of manufacturing pipes having sections with different wall thicknesses from an initially plane sheet metal.

2. Description of the Related Art

German Patent 33 43 709 A1 discloses a method of forming frame components of motor vehicles in which a sheet metal is initially rolled in such a way that parallel indentations are formed. These different wall thicknesses are to result from rolling the sheet metal by means of a roll having sections with different size diameters.

The rolled sheet metal is subsequently cut to size and the individual pieces are bent in longitudinal direction. In this manner, it is possible to produce frame components which have different wall thicknesses in cross-section, while having in longitudinal direction always a constant cross-section. It is not possible to produce areas with partially reduced wall thicknesses in longitudinal direction of the frame components in order to take into consideration peak stresses to be expected locally. The present invention starts at this point.

SUMMARY OF THE INVENTION

Therefore, it is the primary object of the present invention to provide an economical method of manufacturing pipes in a material-saving and weight-saving manner, particularly as intermediate products for structural components which may be subjected over the length thereof to different loads.

In accordance with the present invention, the above-described object is met by a method in which a starting sheet metal is subjected to a rolling deformation so as to intentionally produce areas of different wall thicknesses in rolling direction. Subsequently, the rolled sheet metal is cut to size as required. The intermediate product obtained in this manner is then shaped into a pipe and the abutting edges are then joined together.

The method according to the present invention makes it possible to produce a pipe which has sections with different wall thicknesses in the direction of the longitudinal axis of the pipe. This pipe having sections with reduced wall thicknesses is used for the manufacture of structural components which are subjected to extreme loads, wherein, however, the occurring stresses have different magnitudes as seen over the structural component as a result of the configuration of the structural component. Examples for such structural components which are subjected to different loads are body components or chassis components of motor vehicles.

If the structural components were to be dimensioned in accordance with the maximum load, this has resulted in the past not only in an unnecessary use of material, but also an unnecessary weight. These disadvantages are avoided in the method according to the present invention by using pipes for the manufacture of the structural components which are dimensioned differently in accordance with the loads to be expected later in the individual areas of the structural components. Accordingly, the loads to be expected later can be absorbed and, moreover, material and, thus, weight can be saved.

In accordance with an advantageous feature, a sheet metal is used as the starting material which has a thickness corresponding to the section having the greatest wall thickness of the pipe to be manufactured. Of course, it is also possible to make available a sheet metal as a starting material which has an appropriate excess dimension. The starting material is advantageously pulled from a coil and is conveyed to further processing by rolling technology.

A partial wall thickness reduction is then produced by rolling in accordance with the requirements of later use of the pipes. In this connection, the present invention makes it possible to adapt the rolling direction to the respective configuration of the pipe to be produced. The starting sheet metals may also be rolled partially twice or even several times in different directions. This makes it possible to vary the respective thickness in accordance with the requirements in a step-like manner. Different rates of elongation due to rolling and different transition areas between the thicker and thinner areas are possible. The transitions from one thickness portion of the sheet metal to the other may be without steps or with steps.

Rolling can be carried out in a two-high roll stand. By varying the roll geometry at the roll entry, the symmetry with respect to the transverse middle plane can be influenced within predeterminable limits.

The sheet metal deformed in the above-described manner intentionally is provided with varying cross-sections in order to provide the sheet metal exactly with those wall thicknesses in different areas in accordance with the later requirements. These wall thicknesses are adapted to meet the expected loads and, thus, the locally differing peak stresses to which these areas are subjected in practical use.

After the deformation in a roll stand, the sheet metal is cut to size, the sheet metal is shaped about the longitudinal axis into a pipe and the edges are joined together. This is usually done by welding the joints. The methods available for this purpose are, for example, laser welding, shielded arc welding, inductive welding or resistance welding.

Since the rolling process makes it possible to produce symmetrical geometries as well as substantially asymmetrical geometries, it is recommended to place on the outer side of the pipe the side having the smaller steps or the essentially smooth side.

In accordance with another feature of the present invention, prior to the further processing step for deforming the sheet metal, the sheet metal can be divided into sheet metal strips extending parallel to the rolling direction. In this manner, it is possible to manufacture several pipes having the same configuration from one large initial sheet bar.

The deformation of the sheet metal or sheet metal strips into pipes may be carried out in rolling-round plant. In accordance with another advantageous embodiment, the rolled sheet metal is initially shaped in a die into a semicircular profile and the final deformation into a pipe is carried out subsequently in another pressing step.

If necessary, a pipe can also divided into shorter length sections.

The method according to the present invention is particularly suitable for manufacturing pipes used in the production of motor vehicles.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
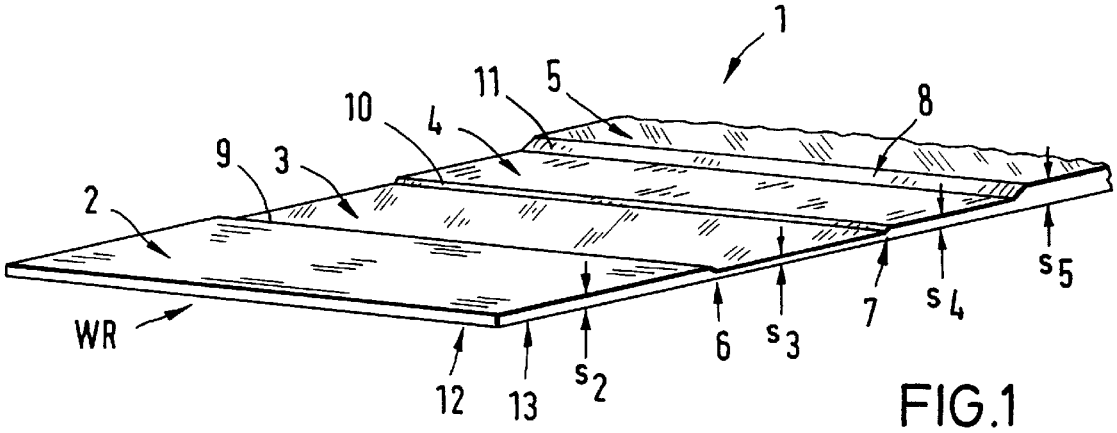
FIG. 1 is a perspective view of a drawn sheet metal with sections of different thicknesses.

FIG. 1 of the drawing shows a portion of a sheet metal 1 which is provided by a rolling deformation into sections 2–5 which have different wall thicknesses $s_2$–$s_5$ which change in rolling direction WR.

In the transition areas 6, 7 and 8, the sections 2–5 are connected almost without steps with inclined portions 9, 10, 11.

The sheet metal 5 has an essentially smooth surface 13 at the bottom side 12.

Figure 2:
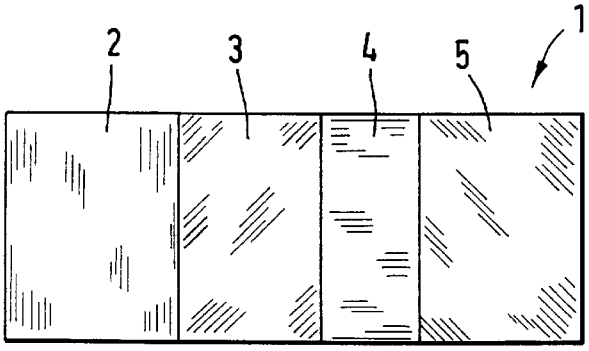
FIG. 2 is a top view of the sheet metal of FIG. 1.

FIG. 2 is a top view of the sheet metal 1. In the deformed sheet metal 1, the sections 2–5 intentionally have those wall thicknesses which are adapted to the respective loads and peak stresses to which a pipe manufactured from the sheet metal 1 is subjected or which result from the practical use of the pipe a structural component.

Figure 3:
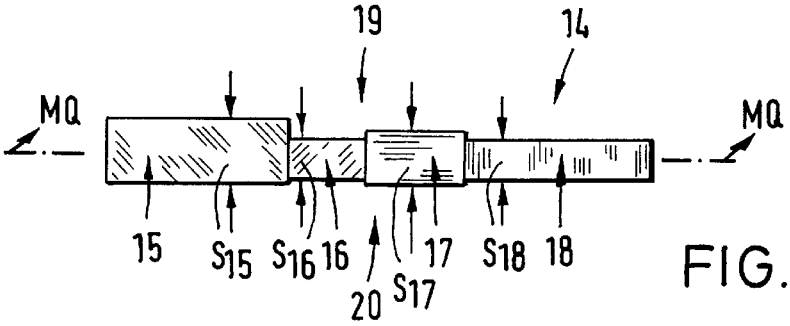
FIG. 3 is a side view of another embodiment of a sheet metal.

FIG. 3 shows a sheet metal 14 which has an asymmetrical geometry in relation to its transverse middle plane MQ with areas 15–18 of different thicknesses $s_{15}$–$s_{16}$. The upper side 19 as well as the bottom side 20 of the sheet metal 14 vary accordingly in a step-like manner over different portions. Since the surface 19 has the greater steps, the deformation of the sheet metal into a pipe is advantageously carried out in such a way that the upper side 19 forms the inner side of the pipe and the bottom side 20 forms the outer side of the pipe.

Figure 4:
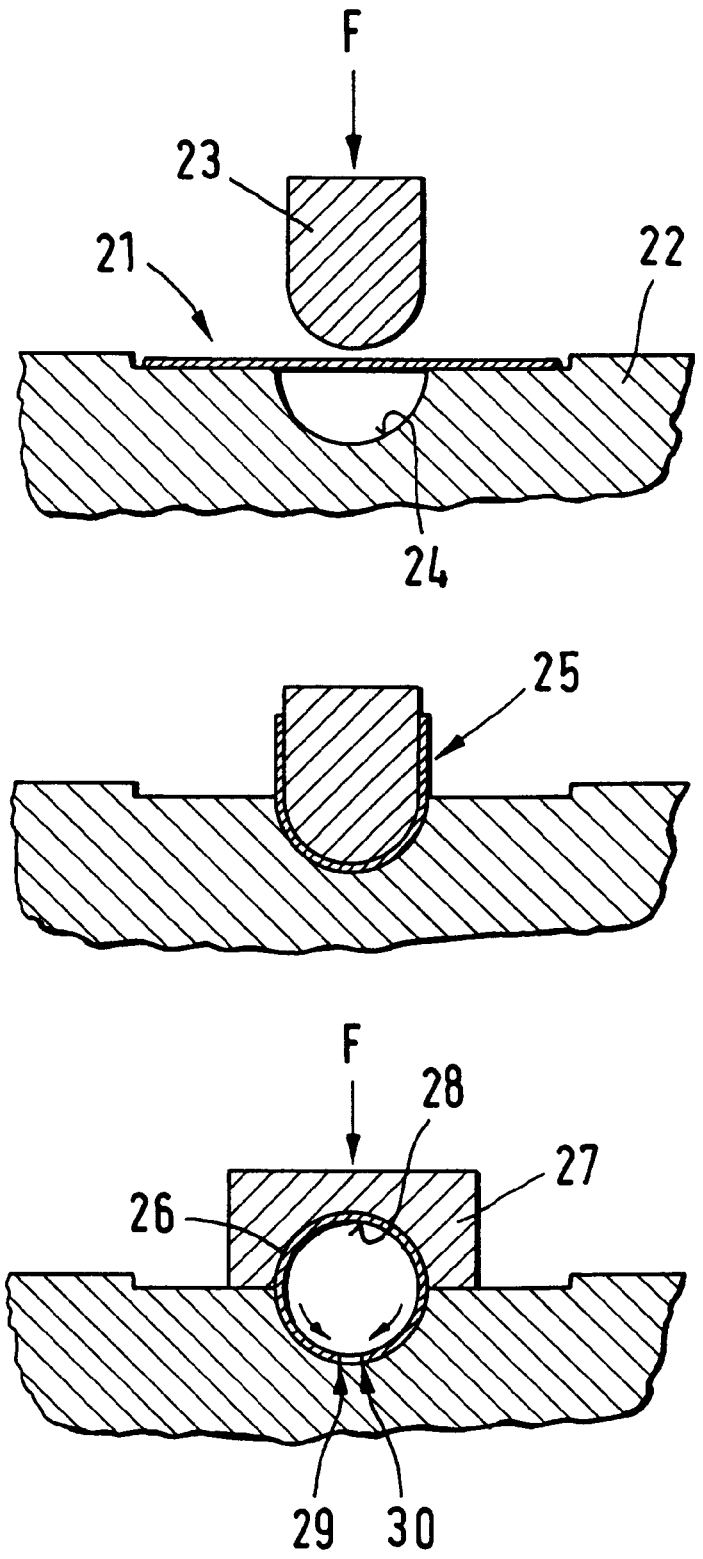
FIG. 4 shows the deformation process of a sheet bar into a pipe in three steps.

The manufacture of a pipe from a sheet bar 21 is technically generally described with the aid of FIG. 4.

In this manner, pipes can be manufactured economically and with high precision. Prior to the deformation into a pipe, the initially plane sheet bar can be reduced over sections thereof in its wall thickness and can subsequently be cut to size. The different dimensions of the wall thickness are adapted to the later loads of the further processed pipe in practical operation.

The sheet bar 21 is placed in a mold 22 as shown at the top of FIG. 4. The sheet bar 21 is subjected to an upper die 23 as indicated by arrow F. This forces the sheet bar 21 into the mold 24 and a semicircular profile 25 is formed, as shown in the middle of FIG. 4.

In the next step, the deformation into a pipe 26 is carried out in the mold 24 by means of the upper die 27 which has a configuration adapted to the shape of the pipe 26 with a counter-mold 28, as shown at the bottom of FIG. 4.

Subsequently, the abutting edges 29, 30 are joined together by means of automatic laser welding with seam recognition and seam tracking.

The pipe 26 manufactured in this manner is then available for further processing. It has sections with different wall thicknesses in axial direction. This configuration is precisely adapted to the later use of the pipe and the occurring loads and stresses to which the pipe 26 will then be subjected.

The invention is not limited by the embodiments described above which are presented as examples only but can be modified in various ways within the scope of protection defined by the appended patent claims.

We claim:

1. A method of manufacturing a pipe having sections with different wall thicknesses in a direction of a longitudinal axis of the pipe from an initially plane sheet metal, the method comprising:

(a) rolling the sheet metal so as to produce sections having different wall thicknesses in a rolling direction which is the direction of the longitudinal axis of the pipe being formed;

(b) cutting the rolled sheet metal to size;

(c) deforming the rolled sheet metal into the pipe; and (d) joining together abutting edges of the sheet metal; the different wall thicknesses being provided to resist local stresses, while simultaneously optimizing the weight of the pipe.

2. The method according to claim 1, wherein, prior to deforming the sheet metal, the sheet metal is divided into strips extending parallel to the rolling direction and the strips are further processed in accordance with steps c) and d).

* * * * *